United States Patent [19]

Kaselow

[11] Patent Number: 4,830,602

[45] Date of Patent: May 16, 1989

[54] GAS RANGE WITH AT LEAST ONE BURNER COVERED BY A GLASS CERAMIC PLATE

[75] Inventor: Dietmar G. Kaselow, Hemer, Fed. Rep. of Germany

[73] Assignee: Cramer GmbH & Co., Kommanditgesellschaft, Menden, Fed. Rep. of Germany

[21] Appl. No.: 101,188

[22] Filed: Sep. 25, 1987

[30] Foreign Application Priority Data

Sep. 26, 1986 [DE] Fed. Rep. of Germany ..... 3632859

[51] Int. Cl.[4] ..... F23N 5/10

[52] U.S. Cl. ..... 431/80; 431/256; 431/328; 126/39 E

[58] Field of Search ..... 126/39 E, 39 J; 431/68, 431/72, 73, 80, 328, 329, 256; 136/217; 251/207

[56] References Cited

U.S. PATENT DOCUMENTS

| | | | |
|---|---|---|---|
| 3,813,207 | 5/1974 | Ramey | 431/255 |
| 4,147,494 | 4/1979 | Ando et al. | 431/71 |
| 4,203,779 | 5/1980 | Kojima et al. | 136/233 |
| 4,580,550 | 4/1986 | Kristen et al. | 126/39 J |

FOREIGN PATENT DOCUMENTS

| | | | |
|---|---|---|---|
| 1948075 | 7/1970 | Fed. Rep. of Germany | 251/207 |

OTHER PUBLICATIONS

W. German Utility Model #25517.7 (Aug. 1986) to Andrejewski et al. (commonly assigned).

*Primary Examiner*—Samuel Scott
*Assistant Examiner*—Allen J. Flanigan
*Attorney, Agent, or Firm*—Herbert Dubno

[57] ABSTRACT

Gas range with at least one burner covered by a glass ceramic plate, wherein the burner has a gas cock and a timed-ignition and monitoring device, such that the output of the burners is adjustable. A gas cock is used with plugs rotatable between a high and a low position with the aid of a knob and a knob shaft, with a spindle connected to the knob shaft, with a valve plate under the gas inlet opening in the plug housing, with a microswitch for the ignition device and with the use of an electromagnet under the valve plate, in the area of the gas supply connection of the further housing. The knob with the knob handle and the spindle is pressable against the action of a return spring in the high position of the plug. This way, the microswitch for the timed ignition device becomes actuatable and the valve plate becomes pressable on the electromagnet against the action of a return spring, thereby opening the combustion gas inlet opening. The monitoring device has thermoelement reaching deeply into the flame of the burner, which generates a thermal current after maximum 10 sec., feeding the electromagnet and holding the valve plate. The design of the thermoelement and of the electromagnet are such that the electromagnet releases the valve plate and interrupts the gas supply when the flame of the burner is interrupted for up to 60 sec. or for more than 60 sec.

6 Claims, 5 Drawing Sheets

GAS RANGE WITH AT LEAST ONE BURNER COVERED BY A GLASS CERAMIC PLATE

Generically, this invention relates to a gas range with at least one burner which is covered by a glass ceramic plate, whereby the burner has a cock and a timed-ignition and monitoring device, whereby further the output of the burner is adjustable, i.e. manually adjustable, and whereby the combustion air flows through the burner due to convection and the exhaust gas is delivered to a gas exhaust duct.

BACKGROUND OF THE INVENTION

In the known generic gas range, the timed-ignition and monitoring device is an electronic unit. The output adjustment takes place by switching the burner on and off more or less frequently. Monitoring of the flame is generally performed with the aid of an ionisation sensor. When there is no gas flame, the electronic device blocks the gas supply via a solenoid valve. These known steps have the advantage of very short and precise switching times. Release of unburned gas is prevented due to the intrinsical safety of the control device. However, the presence of relatively extensive electronic components and necessity of translating the thereby generated electronic signals into mechanical ones and the relatively high cost resulting therefrom are disadvantageous.

In the known gas range, the electronic unit must meet certain established safety regulations. Among these are included a regulation that the burner has to self-ignite when the ignition device has been activated for more than 10 sec. and that the gas supply is cut off, even with the gas cock still open, after a maximum of 60 sec. from the moment the burner was extinguished.

In gas ranges which do not have a glass ceramic plate covering the burner, the afore-mentioned regulations do not apply. In such gas ranges, there are known gas cocks with plugs rotatable between the high and low positions via knobs and knob shafts, with spindle connected to the knob shaft, with a valve plate under the opening for the combustion gas supply in the plug housing, with a microswitch for the ignition device, as well as with an electromagnet inset under the valve plate in the area of the combustion gas supply connection. Thereby, the knob with the knob shaft and the spindle is pressable against the action of a return spring. When the plugs are set for the high position and thereby the microswitch for the timed ignition device becomes actuatable, the plugs as well as the valve plate can be pressed on the electromagnet against the action of another return spring as soon as an assigned thermoelement generates enough thermal current. These gas ranges do not comply with the mentioned regulations for the generic non-ceramic plate type gas ranges. Up to now, the gas cock technology employed with ceramic plate ranges has not been applied to the development of the generic gas ranges.

It is the object of the present invention to further develop a generic gas range, so that it is no longer necessary to use a special electronic unit for the ignition- and monitoring device.

SUMMARY OF THE INVENTION

The solution to the aforestated problem consists in the use of a gas cock with plugs rotatable between a high and low position by means of a knob and a knob shaft, with a spindle connected to the knob shaft, with a valve plate under an inlet opening for the combustion gas in the plug housing, with a microswitch for the ignition device and the use of an electromagnet under the valve plate in the area of the combustion gas supply connection of the further housing. With this arrangement, the knob with the knob shaft and the spindle are pressable against the action of a return spring when the plug is set for the high position. Thereby the microswitch for the ignition device becomes actuatable and the valve plate becomes pressable unto the electromagnet against the action of a return spring. The inlet opening becomes therethrough opened to allow passage of combustion gas. The monitoring device has a thermoelement reaching deeply into the flame of the burner. A thermal current is generated in the monitoring device after a maximum of 10 sec. which actuates the electromagnet and holds the valve plate. When the flame of the burner has been out up to 60 sec. or more than 60 sec. the electromagnet releases the valve plate and interrupts the combustion gas supply. In a preferred embodiment of the invention, the gas cock has a valve plate reclose blocking means which in a manner known per se precludes cut off in gas supply when the burner is extinguished and the gas cock is still open. The reclose blocking means allows a new ignition to take place, as long as the electromagnet insert has not yet released the plate and the gas supply has been interrupted.

The invention is based on the concept that in a generic gas range, instead of the electronic unit, a cock of the described construction, heretofore applied only in the case of open burners, can be used and still make sure that the regulations existing for gas ranges with a covering glass ceramic plate are complied with, when the monitoring device has a thermoelement reaching sufficiently deep into the flame of the burner and which after 10 sec. generates a thermal current supplying the electromagnet. Furthermore, the design of the thermoelement and the electromagnet must be such that the electromagnet releases the valve plate and interrupts the combustion gas supply when the flame of the burner is out for up to 60 sec. or for longer than 60 sec. Very short lapse periods can be achieved, when the thermoelement is surrounded by a thermoinsulating wrapping, e.g. mineral wool, up to the front of the thermosensor, which is approx. 10 millimeters long. Positioning of the thermosensor at a distance of approx. 2 millimeters above the ceramic plate also contributes to this effect. In this connection, a preferred embodiment is characterized by that the thermosensor lies at least with its point in the path of the convection air flow, which after the flame is extinguished, is directed towards the exhaust gas duct.

BRIEF DESCRIPTION OF THE DRAWING

The invention is now explained in more detail with the aid of the drawing, representing one embodiment example, which shows.

DETAILED DESCRIPTION

Figure 1:
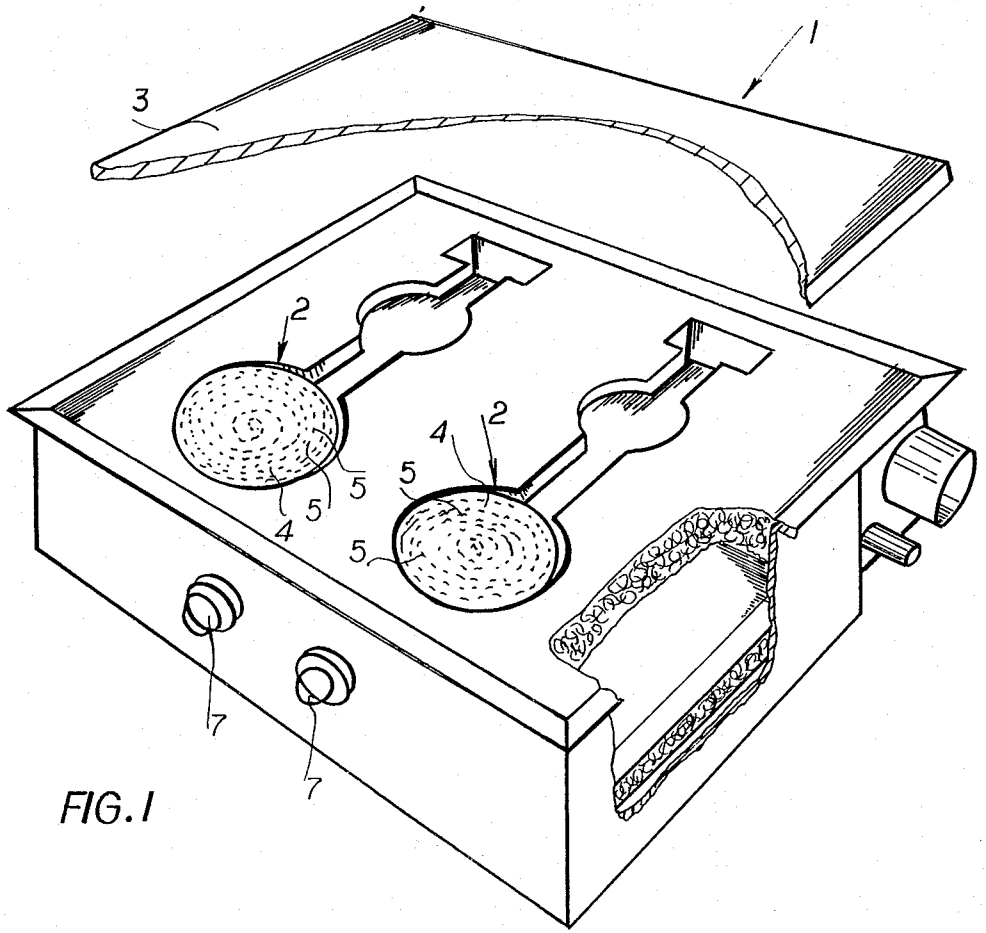
FIG. 1 a perspective view of a gas range according to the invention, with lifted glass ceramic plate, partially broken.
Figure 2:
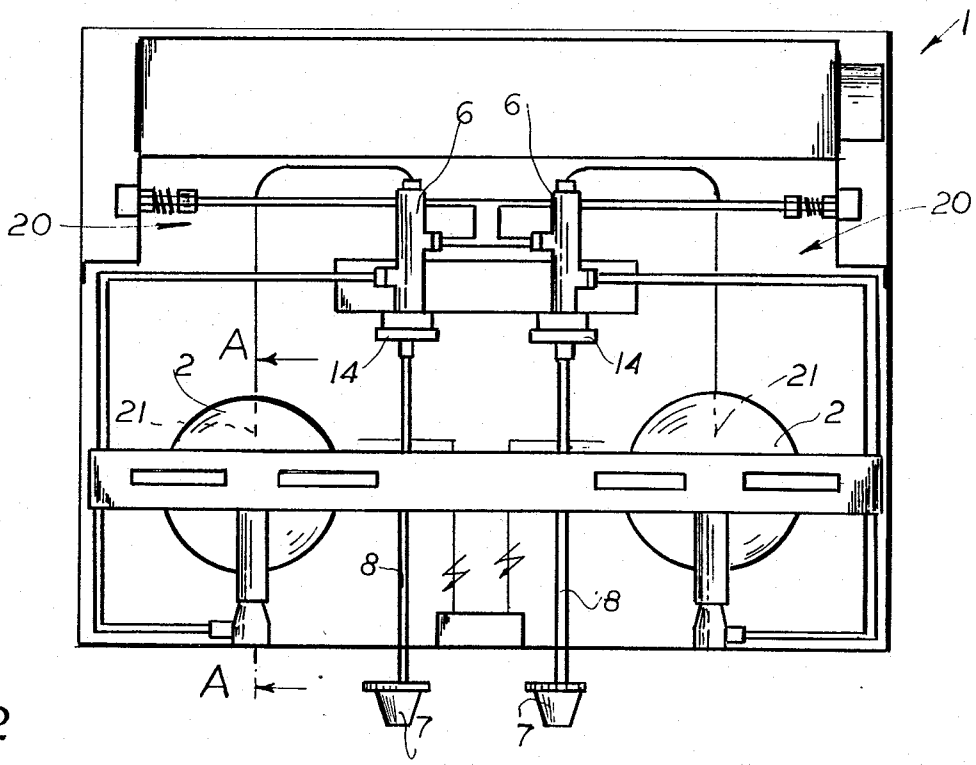
FIG. 2 the gas range according to FIG. 1, seen from underneath.

In the embodiment example, the gas range 1 represented in the figures has two burners 2, covered by a glass ceramic plate 3. The burners 2 have in turn a ceramic plate 4 with a multitude of nozzle openings 5, where the burning takes place.

Each burner 2 has gas cock 6 and timed ignition and monitoring device. The output of the burners 2 is adjustable, i.e. manually adjustable.

Figure 3:
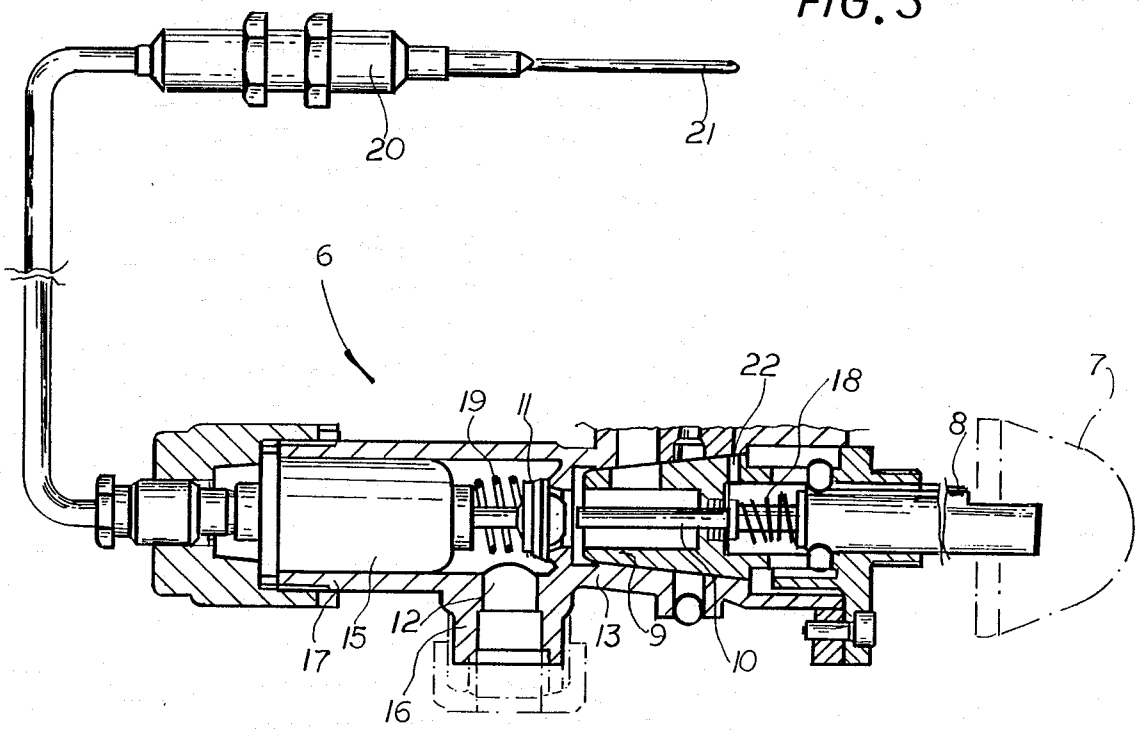
FIG. 3 a longitudinal section through the gas cock of the gas range according to the invention with pertaining devices, at a considerably larger scale in comparison with FIGS. 1 and 2.

In the gas range according to the invention, a special gas cock 6 is used, which has been detailed in FIG. 3. Gas cock 6 includes plugs 9 rotatable between a high and a low position by means of knob 7 and a knob shaft 8, with a spindle 10 connected to the knob shaft 8, with valve plate 11 underneath the inlet opening 12 for the combustion gas, located in the plug housing 13, with microswitch 14 for the ignition device and electromagnet 15 under the valve plate 11 in the area of the combustion gas supply connection on the further housing 17. When the plug 9 is in the high position, the knob 7 with the knob shaft 8 and the spindle 10 are pressable against the action of a return spring, in the direction indicated by the arrow. The arrangement is made in such a manner that thereby the microswitch becomes actuatable for the ignition and the valve plate 11 can be pressed on the electromagnet inset 15 against the action of the return spring 19. In comparison with the traditional use of such a gas cock 6 in a gas range with open burners, the monitoring device presents a considerably longer thermoelement 20, which reaches deeply into the flame of the burner. The arrangement and the layout are such that after maximum 10 sec. a thermal current is generated which supplies the electromagnet and holds the valve plate 11. Furthermore, the design of the thermoelement 20 and the electromagnet 15 are such that the electromagnet 15 releases the valve plate 11 and interrupts the combustion gas supply, when the flame of the pertaining burner 2 has been out for up to 60 sec. or for more than 60 sec.

Safety regulations mentioned under the Background discussion are complied with in the following way. On the one hand, it is insured that in the gas range 1 according to the invention the self-fastening of the valve plate 11 over the electromagnet 15 takes place after at most 10 sec. following the ignition of the burner.

On the other hand, the valve plate 11 falls away from the electromagnet inset 15, causing an interruption in the gas supply, when with the still open gas cock 6 a time span of up to 60 sec. or longer has lapsed, after the burner 2 was extinguished, for whatever reason.

Surprisingly, the second requirement can be met, in spite of the fact that in a gas range of this kind the burner 2 has a ceramic plate 4 with a multitude of nozzle openings 5, as it has already been mentioned. This ceramic plate 4 has a few seconds of afterglow, which for the thermoelement 20 creates the appearance of a still burning flame, so that the previously indicated time barrier of 60 sec. can not be reached without difficulties. In fact, in this connection, the thermoelements usually available in commerce have a thermosensor length of approx. 15 mm. They would supply to the electromagnet 15 a current of more than 20 mA. A commercially available electromagnet 15 lapses only after 40 mA, so that the valve plate 11 closes. This way, holding times of far more than 60 sec. result. Nevertheless, the described requirement according to which the gas supply has to be interrupted after a maximum of 60 sec. from the moment the burner 2 is out, is achieved with the present invention when at the thermoelement 20 the actual thermosensor is lengthened to about 40 mm, so that it can reach far into the hot flame of the burner 2. The increased length permits the thermal current to reach over 300 mA very quickly. The voltage difference between the operational state on the one hand with the flame and on the other hand without the flame increases, the effect of the radiation heat is diminished and the indicated time span of 10 sec. for the holding of the valve plate 11 through the electromagnet 15 can be easily achieved this way. The valve plate 11 has according to the invention a sufficiently strong return spring 19, so that a high closing performance is insured. An interruption of the gas stream i.e. the fastening of the valve plate 11 on the electromagnet 15, takes place starting only from 280 mA. Due to the relatively long thermosensor 21 of the thermoelement 20, this is easily reached in less than 10 sec. As a result of the higher spring tension, the valve plate 11 falls away already at, for instance 110 mA thermal current passing through the electromagnet 15. Disconnecting times of considerably less than 60 sec. can be achieved as a result.

The reclose blocking means 22 which is an integral part of the gas cock prevents a reignition when the burner is out and the gas cock 6 is still open, as long as the valve plate 11 is still being held by the electromagnet 15 and the gas keeps on streaming to the burner. It is self-understood that the lapse period at the cock 6 can be reduced also by directing the thermal current over a low-ohmic resistance, connected between the thermoelement 20 and the electromagnet 15, which limits the thermal current so that it surpasses only by very little the holding current of the electromagnet 15, under normal operational circumstances. This way also a quick lapse can be achieved.

Figure 4:
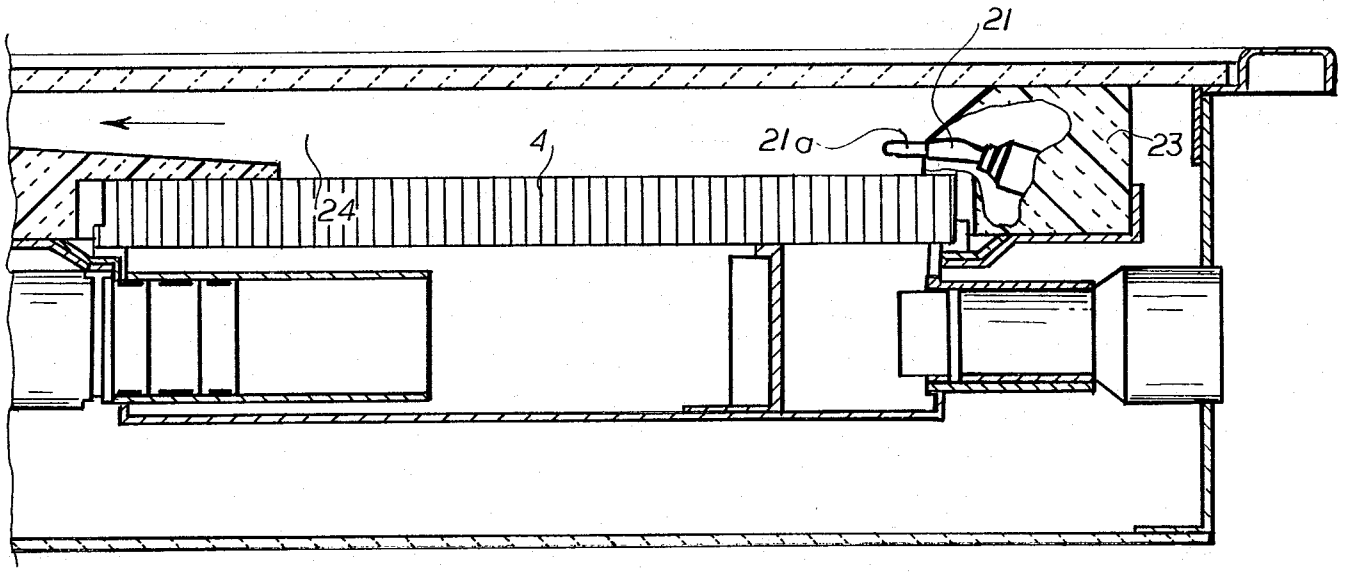
FIG. 4 a section AA through the object of FIG. 2, in enlarged scale by comparison with FIGS. 1 and 2.
Figure 5:
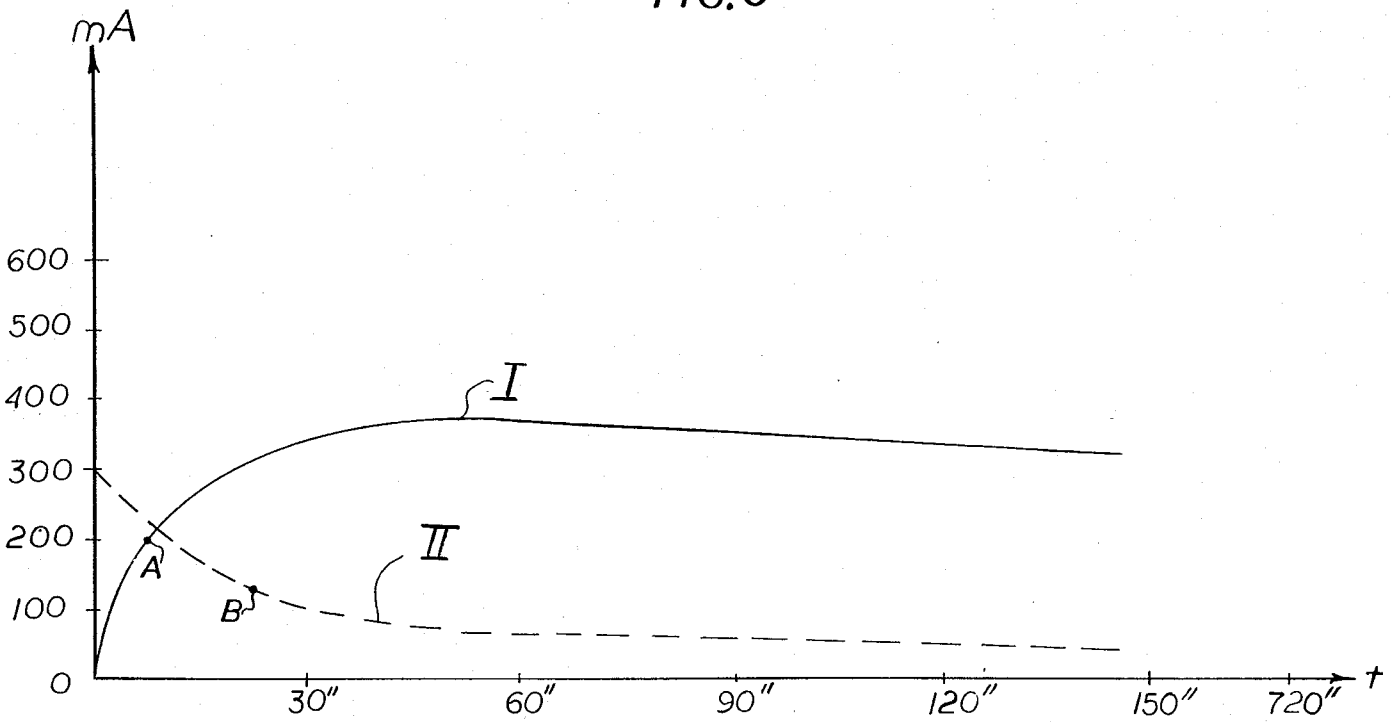
FIG. 5 a graphic representation, explaining the dependency of the thermal current on the time after the turning on and after the extinguishing of the flame.

FIG. 4 shows that the thermoelement 20 is surrounded by heat-insulating wrapping 23, consisting for instance of mineral wool, up to the point 21*a* of approx. 10 mm of its thermosensor 21, whereby the point 21*a* of the thermosensor 21 is mounted at a distance of approx. 2 mm above the ceramic plate. It can be seen that the thermosensor 21 lies with its point 21*a* in the path of the convection air flow, which flows towards the exhaust gas duct 24, after the flame is extinguished.

I claim:

1. Gas range with at least one burner comprising:

a glass ceramic plate covering said burner;

a knob and a respective knob shaft;

said burner comprising a porous ceramic plate having a plurality of transverse passages formed therein through which an ignitable fuel mixture may pass, such that a flame will form and be anchored upon an upper surface of said porous plate;

a gas cock controlling the flow of fuel to said burner, including:

a plug shiftable between a high and a low volume combustion gas delivery setting, said plug being rotatable through manipulation of the combination of said knob and said respective knob shaft;

a first return spring interposed between said knob shaft and said plug;

a spindle connected to said knob shaft;

a plug housing containing said plug;

a combustion gas connection conduit leading into said plug housing;

a combustion gas inlet opening formed in said plug housing and at an end of said combustion gas connection conduit;

a valve plate positioned under said combustion gas inlet opening;

an electromagnet inserted under said valve plate in an area of the combustion gas connection conduit;

a second return spring connected to said electromagnet;

a timed-ignition device including a microswitch communicating with said shaft whereby the knob and respective knob shaft and the spindle in the high gas delivery setting position of the plug can be pressed in against the action of said first return spring thereby actuating the microswitch for timed ignition and causing the valve plate to press the electromagnet against the action of said second return spring opening the combustion gas inlet; and a monitoring device having a thermoelement and at an end thereof a thermosensor, said thermosensor reaching deeply into a flame generated by said burner, said monitoring device generating a thermoelectric current after a maximum of 10 seconds which current feeds the electromagnet causing said electromagnet to release the valve plate and interrupting supply of combustion gas when the flame of the burner is interrupted for 60 seconds or for more than 60 seconds.

2. Gas range according to claim 1 wherein the gas cock further includes a reclose blocking means which prevents a new ignition when the flame of the burner is extinguished and the gas cock is still open, as long as the electromagnet has not yet released the valve plate and interrupted the gas supply.

3. Gas range according to claim 1 wherein the thermosensor is more than 10 millimeters long and the thermosensor is surrounded by a heat-insulating wrapping up to a point that is approximately 10 millimeters distant from an end of the thermosensor.

4. Gas range according to claim 3 wherein said heat-insulating wrapping is mineral wool.

5. Gas range according to claim 3 wherein said point of the thermosensor is arranged at a distance of approximately 2 millimeters over the ceramic plate.

6. Gas range according to claim 1 wherein said end of said thermosensor lies at least in an air flow convection path which path after the extinguishing of the flame flows towards an exhaust gas duct of said range.

* * * * *